United States Patent [19]

Mori

[11] Patent Number: 4,820,063

[45] Date of Patent: Apr. 11, 1989

[54] TYPEWRITER WITH A CORRECTION FUNCTION

[75] Inventor: Masaharu Mori, Anjo, Japan

[73] Assignee: Brother Kogyo Kabushiki Kaisha, Nagoya, Japan

[21] Appl. No.: 15,148

[22] Filed: Feb. 17, 1987

[30] Foreign Application Priority Data

Feb. 20, 1986 [JP] Japan ..... 61-36743

[51] Int. Cl.[4] ..... B41J 11/44; B41J 19/14

[52] U.S. Cl. ..... 400/76; 400/279; 400/551; 400/697

[58] Field of Search ..... 400/61, 76, 279, 550, 400/551, 582, 697, 904; 364/519

[56] References Cited

U.S. PATENT DOCUMENTS

| | | | |
|---|---|---|---|
| 4,207,011 | 6/1980 | Pascoe | 400/76 |
| 4,374,626 | 2/1983 | Hooker | 400/697.1 |
| 4,392,758 | 7/1983 | Bowles et al. | 400/279 X |
| 4,448,557 | 5/1984 | Hosu et al. | 400/279 |
| 4,480,931 | 11/1984 | Kanikura et al. | 400/279 X |
| 4,481,603 | 11/1984 | McCashill et al. | 400/279 X |
| 4,561,793 | 12/1985 | Blanchard, Jr. | 400/697 |
| 4,607,966 | 8/1986 | Ueno et al. | 400/279 X |
| 4,618,275 | 10/1986 | Brinkmann et al. | 400/76 |

FOREIGN PATENT DOCUMENTS

| | | | |
|---|---|---|---|
| 3,425,504 | 1/1986 | Fed. Rep. of Germany | 400/697.1 |

*Primary Examiner*—Edgar S. Burr
*Assistant Examiner*—James R. McDaniel
*Attorney, Agent, or Firm*—Parkhurst, Oliff & Berridge

[57] ABSTRACT

An electronic typewriter is provided with a function that the print head is moved leftward linearly when a backspace key is continuously operated after the printing paper is fed more than a preset amount, while the print head traces the printed characters when the printing paper is fed less than the preset amount. The typewriter is convenient in erasing a mistyped character on a printed line with a superscripted or subscripted character and also useful in printing new characters on the same fed printed line.

7 Claims, 7 Drawing Sheets

TYPEWRITER WITH A CORRECTION FUNCTION

BACKGROUND OF THE INVENTION

This invention relates to an electronic typewriter having a correction memory for storing printing data while printing is executed.

In prior art electronic typewriters with a correction function, printing data such as character data and feed data are stored in a correction memory provided in a control section while the characters are printed. The character data are generated in response to the operation of respective character keys and a feed code data is generated in response to the operation of a subscript key (or a paper fore feed key) or a superscript key (or a paper back feed key). The printing paper is fed by a half line spacing responsive to one feed code data by the feed mechanism of the typewriter and henceforth the half line spacing is counted as one unit.

For example, characters "ABCDEF" are printed on a printing paper after the carriage is returned to the left margin position, the subscript key is operated three times and characters "GHIJ" are then printed as shown in FIG. 10. These character code data and the feed code data are stored in the correction memory in that order. When a backspace key (or a backward key) is consecutively operated after the end of the printing of characters "GHIJ", the print head on the carriage retraces the printed line of "GHIJ" backward. The printing paper is reversely fed by the feed code stored in the correction memory and then again retraces the characters in the first printed line (as shown by a solid line in FIG. 10). After the desired position is acquired by the backspace key operations, the operator presses a correction key provided on the keyboard. The printed character at the position is removed, or erased, by the correction mechanism using the corresponding character data stored in the correction memory. The print data stored in the correction memory are cleared when a return key is operated.

The prior art electronic typewriters acting as described above are especially useful in correcting a printed line with superscripted or subscripted characters. The superscripted or subscripted characters are easily erased without requiring the operator to be concerned with paper feed operation.

However, when the feed key is operated a lot of times, it is usually the case that the operator need not retrace to the first line. For example in the FIG. 10, it is more often the case that the operator desires to print in the region 70, shown by a dot line box, when the backspace key is operated. The prior art typewriters have a problem when printing is required within the region, which is one line or more fed from the line of "ABCDEF", after the printing OF "A" through "J" is accomplished. In this case, if the backspace key is operated, the print head retraces the print backward to the position of the first printed line (e.g., at "A" in FIG. 10). Namely, the print head cannot be moved to the region 70 with only the backspace key, but other key operations are required.

SUMMARY OF THE INVENTION

An object of this invention is to provide an improved electronic typewriter in which, when a printing paper is fed more than a predetermined line spacing from a first printed line by operating a subscript key or a superscript key, a print head can be linearly moved toward the left margin position on the same fed line by simply operating the backspace key alone.

The object and other related objects are realized by an electronic typewriter of the invention which includes: a keyboard having a plurality of character keys including a space key for generating respective character code data and a space code data, a fore feed and a back feed keys for generating respective feed code data and other keys; a printing mechanism having a carriage including a print head, a carriage transport mechanism and a paper feed mechanism; and control means for printing respective characters on a printing paper by the print head, for controlling the carriage transport mechanism to move the carriage forward responsive to the character code data and for controlling the paper feed mechanism to feed forward and backward the printing paper responsive to the fore and back feed code data respectively, including a line memory (a correction memory) for storing the character code data and the feed code data in the operated order; wherein the improvement of this electronic typewriter is that the control means further include data clear means for clearing data in the line memory when the printing paper is fed more than a preset amount, while keeping the data in the line memory in other cases.

BRIEF DESCRIPTION OF THE DRAWINGS

The present invention will now be described with reference to the accompanying drawings, in which.

DETAILED DESCRIPTION OF THE PREFERRED EMBODIMENT

Hereinafter, an embodiment of this invention will be described in detail according to FIGS. 1 through 9.

Figure 2:
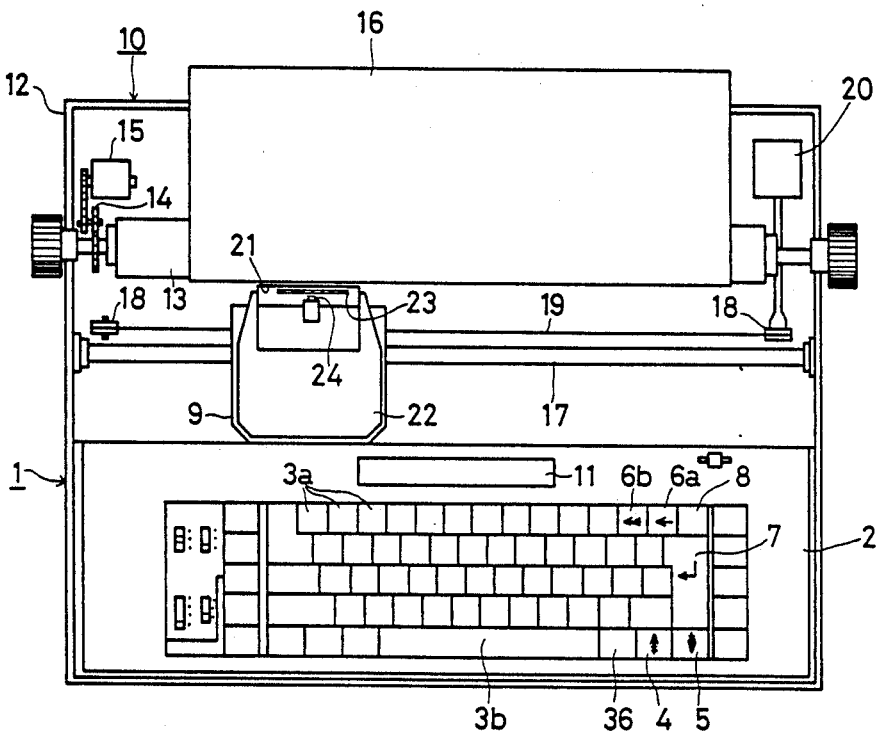
FIG. 2 is a plan view of the electronic typewriter of FIG. 1.

In FIG. 2, an electronic typewriter 1 includes a keyboard 2 having a plurality of character keys 3*a*, a space key 3*b*, a superscript key 4 and a subscript key 5 for feeding paper forward and backward respectively, a backspace key 6*a* for moving a carriage 9 backward, an express backspace key 6*b*, a return key 7, a mode selector key 8 and other keys. When a character key 3*a* or the space key 3*b* is operated, corresponding character code data or a space code data is generated. If the superscript key 4 or the subscript key 5 is operated, coincident feed code data is generated. If the backspace key 6*a* is operated, the carriage 9 moves leftward (reverse to the printing direction). If the express backspace key 6*b* is operated, the carriage 9 moves leftward to the left margin position.

The mode selector key 8 is employed to select an operation mode from among a type mode, a store mode and a print mode. In the type mode, when one of the character keys 3*a* is pressed, a printing device 10 is immediately driven to execute printing. In the store mode, data entered by the key operation are stored in a text memory and not printed on the printing paper. In the print mode, printing is executed by controlling the printing device 10 based on various data stored in the text memory, including character code data, carriage return code data, feed code data, etc.

A display 11 is provided on the center of the upper part of the keyboard 2. Characters entered by the character keys 3*a* and various messages are displayed on the display 11.

The printing device 10 is attached to the keyboard 2, and a platen 13 is rotatably supported by a frame 12. One end of the platen 13 is connected with a line feed motor 15 by means of a gear mechanism 14. The platen 13 rotates forward or backward according to the normal or reverse rotation of the motor 15 so as to feed a printing paper 16.

The carriage 9 is movably supported by a guide rod 17 provided in parallel to the platen 13, and is connected to a carriage drive motor 20 by means of a wire 19 passing over a couple of pulleys 18. The carriage 9 moves rightward or leftward in parallel to the platen 13 according to the normal or reverse rotation of the carriage motor 20. A ribbon cassette 22 containing a printing ribbon 21, a print head having a type wheel 23 and a printing hammer 24 are installed on the carriage 9. Characters are printed by the printing device 10 on the printing paper 16 supported by the platen 13.

Figure 3:
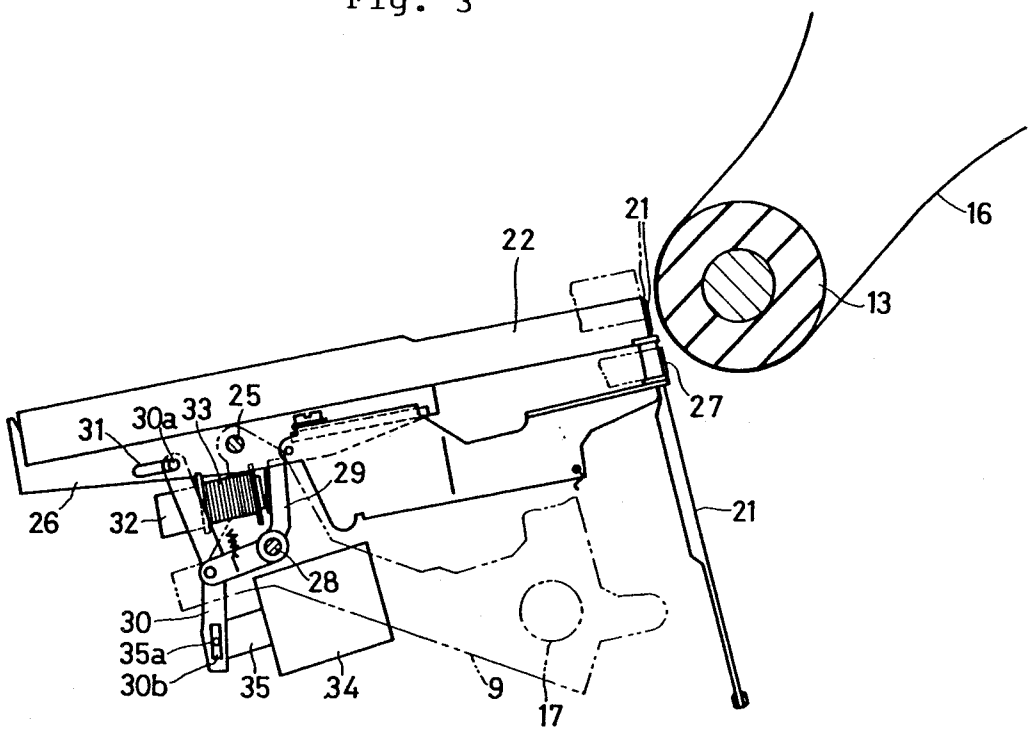
FIG. 3 is a side elevation view of the electronic typewriter, partly in section.

In FIG. 3, a supporting shaft 25 is fixedly mounted on the upper part of the carriage 9. A holder 26 is swingably supported at a center part thereof, by the supporting shaft 25. The ribbon cassette 22 is detachably mounted on the upper surface of the holder 26. Part of the printing ribbon 21 is exposed outside of the ribbon cassette 22 and is disposed opposite to the platen 13. A correction ribbon 27 is disposed below the printing ribbon 21 and opposite to the platen 13. A shaft 28 is supported on the carriage 9 below the supporting shaft 25. A substantially L-shaped lever 29 (a first lever) is supported swingably at the center part thereof on the shaft 28. A second lever 30 is supported on one end of the first lever 29 so as to be swingable between a resting position and a printing position. A slot 31 having a cam generated surface is formed in and is disposed longitudinally on the side wall of the holder 26 near the second lever 30. A coupling pin 30*a* is positioned in the slot 31. The combination of the slot 31 and the coupling pin 30*a* constitute a coupling mechanism for movably coupling the second lever 30 and the holder 26. A first electromagnet 32 having cores 33 and coils wound on the cores 33 is fixed to the carriage 9 so as to be disposed opposite to the upper end of the first lever 29. A swing solenoid 34 (a second electromagnet) is supported near a slot 30*b* of the second lever 30. A pin 35*a* is fixed to the extremity of a plunger 35 of the swing solenoid 34 and is inserted into the slot 30*b* of the second lever 30.

Figure 1:
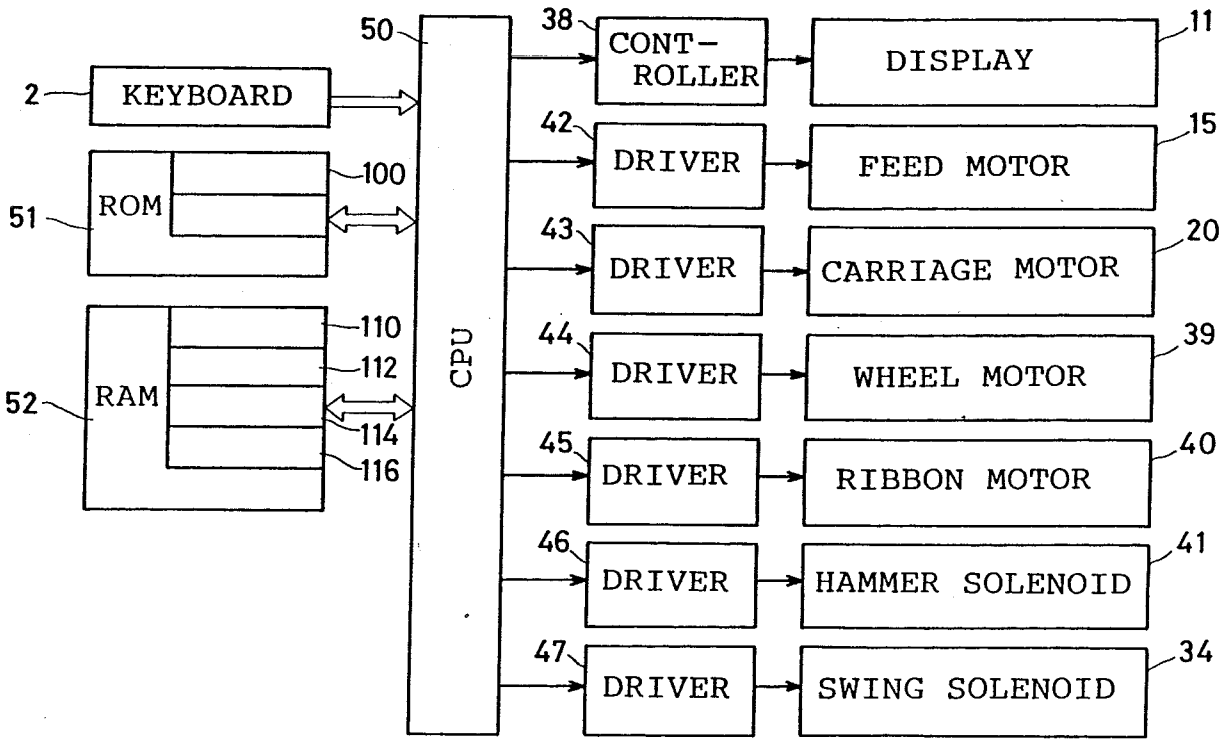
FIG. 1 is a block diagram depicting an electronic circuit component of an electronic typewriter embodying the present invention.

An electronic circuit of the electronic typewriter 1 composed as above will be described according to FIG. 1.

A ROM (Read Only Memory) 51, a RAM (Random Access Memory) 52 and the keyboard 2 are connected to a CPU (Central Processing Unit) 50 which functions as control means including data clear means. The CPU 50 is further connected to a display controller 38 for controlling the display 11, and driver circuits 42 through 47 for controlling the line feed motor 15, the carriage motor 20, a type wheel motor 39, a ribbon feed motor 40, a hammer solenoid 41 and the swing solenoid 34 respectively.

The ROM 51 includes a program memory 100 in which various control programs for controlling the whole of the typewriter 1 are stored. For example, one of the programs is to control the motors 15, 20, 39 and 40 and the solenoids 34 and 41 of the printing device 10 and the display 11 in response to the character code data and the feed code data for printing and displaying the characters. These data are either generated by the operation of the character keys 3*a*, the space key 3*b*, the superscript key 4 or the subscript key 5, or read out from a correction memory (a line memory) 112 (described later) or from a text memory 110. Another program is to control the motors 15, 20, 39 and 40 and the solenoids 34 and 41 of the printing device 10 in response to various functional code data inputted by the operation of the mode selector key 8 or other functional keys.

The RAM 52 includes an input buffer memory 114, the correction memory 112, a current position memory 116, the text memory 110 and other memories for temporarily storing the computed result of the CPU 50. The input buffer memory 114 temporarily stores data inputted from the keys on the keyboard 2. The correction memory 112 stores a certain amount of printed data with their corresponding printing positions in order. The current position memory 116 stores the current horizontal position of the print head. The text memory 110 stores a lot of inputted data.

Fundamental operation of the typewriter is first explained. When the character keys 3*a* are operated, the corresponding character code data is generated and inputted to the CPU 50. The CPU 50 processes the character code data by the control program read out from the program memory 110. The CPU 50 generates control signals corresponding to each data for the driver circuits 42 through 47 and the display controller 38 so as to control the printing device 10 and the display 11. Specifically, to control the printing device 10, first the CPU 50 outputs a control signal to the type wheel motor driver 44. The driver 44 then delivers drive current to the type wheel motor 39 to rotate the type wheel 23 so that the corresponding type face is set at the printing position. Then a control signal is outputted from the CPU 50 to the hammer solenoid driver 46, and drive current is outputted from the driver 46 to the hammer solenoid 41. The type face at the printing position is hit by the printing hammer 24 and the corresponding character is printed on the printing paper 16 via the printing ribbon 21. Then a drive current is outputted from the carriage motor driver 43 to the carriage motor 20 by the command signal from the CPU 50 and the motor 20 moves the carriage 9 rightward by one character position by means of the wire 19. Drive current is outputted from the ribbon feed motor driver 45 to the ribbon feed motor 40 also by the command signal from the CPU 50 and the motor 40 feeds the printing ribbon 21 by a preset distance.

The character code data corresponding to the printed character are stored by the CPU 50 in the correction memory 112 of the RAM 52 in the printed order. The CPU 50 also stores the current position data of the print head in the current position memory 116 of the RAM 52.

When an erroneous character is found typewritten in the current printing line, the carriage 9 is first returned to the error character position by the operator's operation of the backspace key 6*a*. Next, when the operator presses a correction key 36, the CPU 50 processes the corresponding program stored in the program memory 100. The CPU 50 outputs a control signal to the swing solenoid driver 47 and the solenoid 34 is driven to raise the correction ribbon 27 to the printing position. More specifically, the first electromagnet 32 and the solenoid 34 are excited. Consequently, the position of the first lever 29 is changed, and the plunger 35 is modified to the retracted position. Thus, the second lever 30 is turned in a counterclockwise direction through engagement between the pin 35*a* and the slot 30*b* to the operating position. The combined action of the turning of the first lever 29 and that of the second lever 30 through action of the coupling mechanism comprising the coupling pin 30*a* and the cam surface of the slot 31, causes the holder 26 to turn on the supporting shaft 25 to the printing position. The correction ribbon 27, supported on the holder 26, is thus raised to the printing position in front of the platen 13.

Then the type face corresponding to the erroneous character at the present print head position, whose code data is stored in the correction memory 112 corresponding to the position, is then selected by the rotation of the type wheel 23 and is hit by the printing hammer 24 via the correction ribbon 27. Thus, the character printed on the printing paper is erased.

When the return key 7 is operated, the CPU 50 processes a control program read out from the program memory 100 and outputs control signals to the carriage motor driver 43 and the line feed motor driver 42. The carriage motor driver 43 outputs drive current to the carriage motor 20 to rotate the motor 20 reversely so as to return the carriage 9 to the left margin position. At the same time, the line feed motor driver 42 outputs drive current to rotate the line feed motor 15 so as to feed the printing paper by preset units of the half line spacing in the normal direction.

The foregoing describes actions in the type mode. When the store mode is selected by the mode selector key 8, the inputted character code and feed code are stored directly in the text memory 110. In the print mode, the stored code data in the text memory 110 is read out by the CPU 50 one by one and processed as explained above, just like it is inputted from the keyboard 2.

Operation of the typewriter 1 will be described based on flow charts of FIGS. 4A and 4B. The flow charts illustrate the control processing when both the type mode and the store mode are simultaneously selected by the mode selector key 8.

When a key on the keyboard 2 is operated at step S1, it is determined if the key is one of the character keys 3*a*. Here, the space key 3*b* is treated as a character key. When the key 3*a* or 3*b* is operated, the process step S2 is executed where the character code data corresponding to the character key 3*a* or 3*b* is stored into the correction memory 112. At step S3, the character or space is displayed on the display 11 and is printed on the printing paper 16 by the printing device 10. Then, the process steps return to step S1.

When the determination at step S1 is NO, the process proceeds to S4, and it is determined if the operated key is a return key 7. When the determination at step S4 is YES, the process proceeds to step S5 where the CPU 50 controls the carriage drive motor 20 and the line feed motor 15 so as to move the carriage 9 to a preset left margin position, and feed the printing paper by preset units of the half line spacing by rotating the platen 13 in the normal direction. At step S6, the data stored in the correction memory 112 are transferred to the text memory 110 and the correction memory 112 is cleared. Then, the process returns to step S1.

Figure 4A:
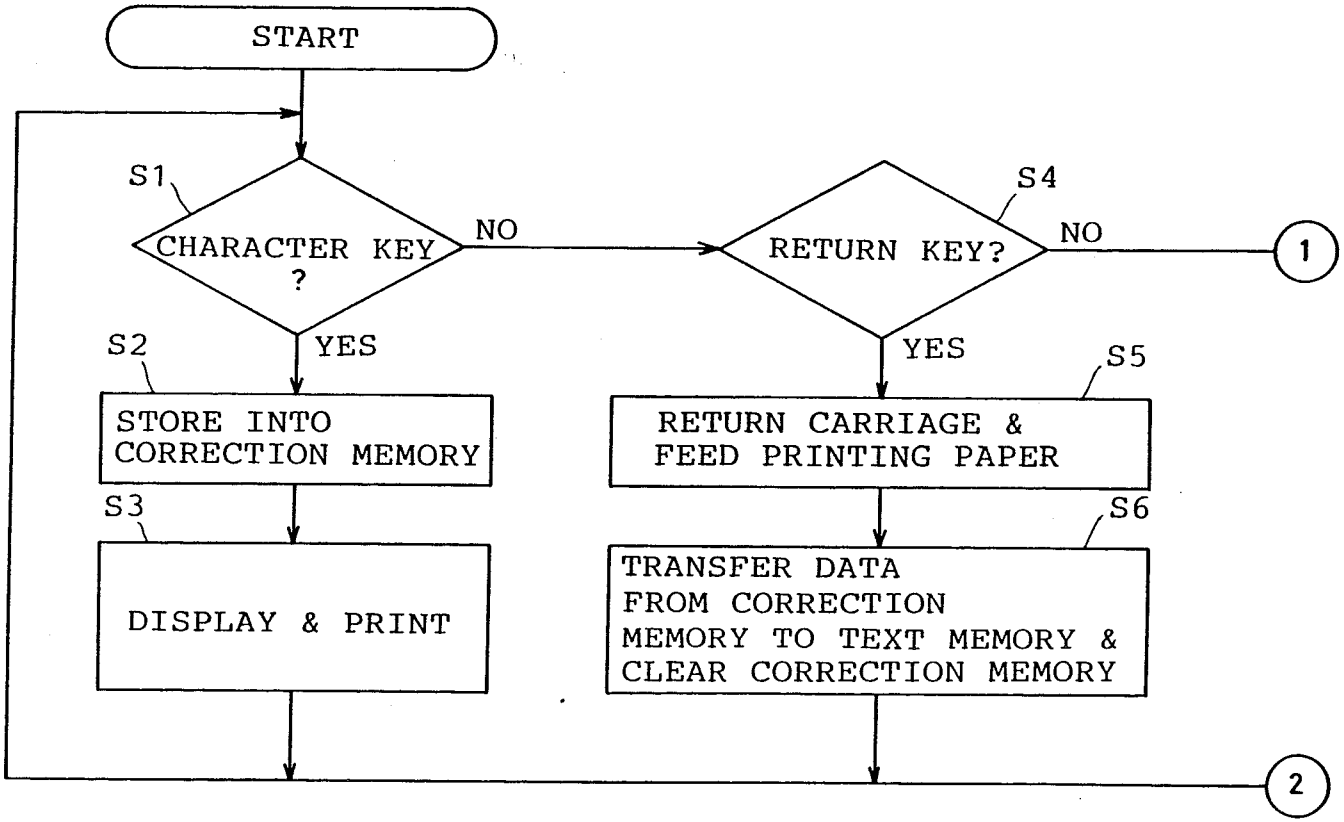
FIGS. 4A and 4B are flow charts illustrating a routine executed in a first embodiment of the invention.
Figure 4B:
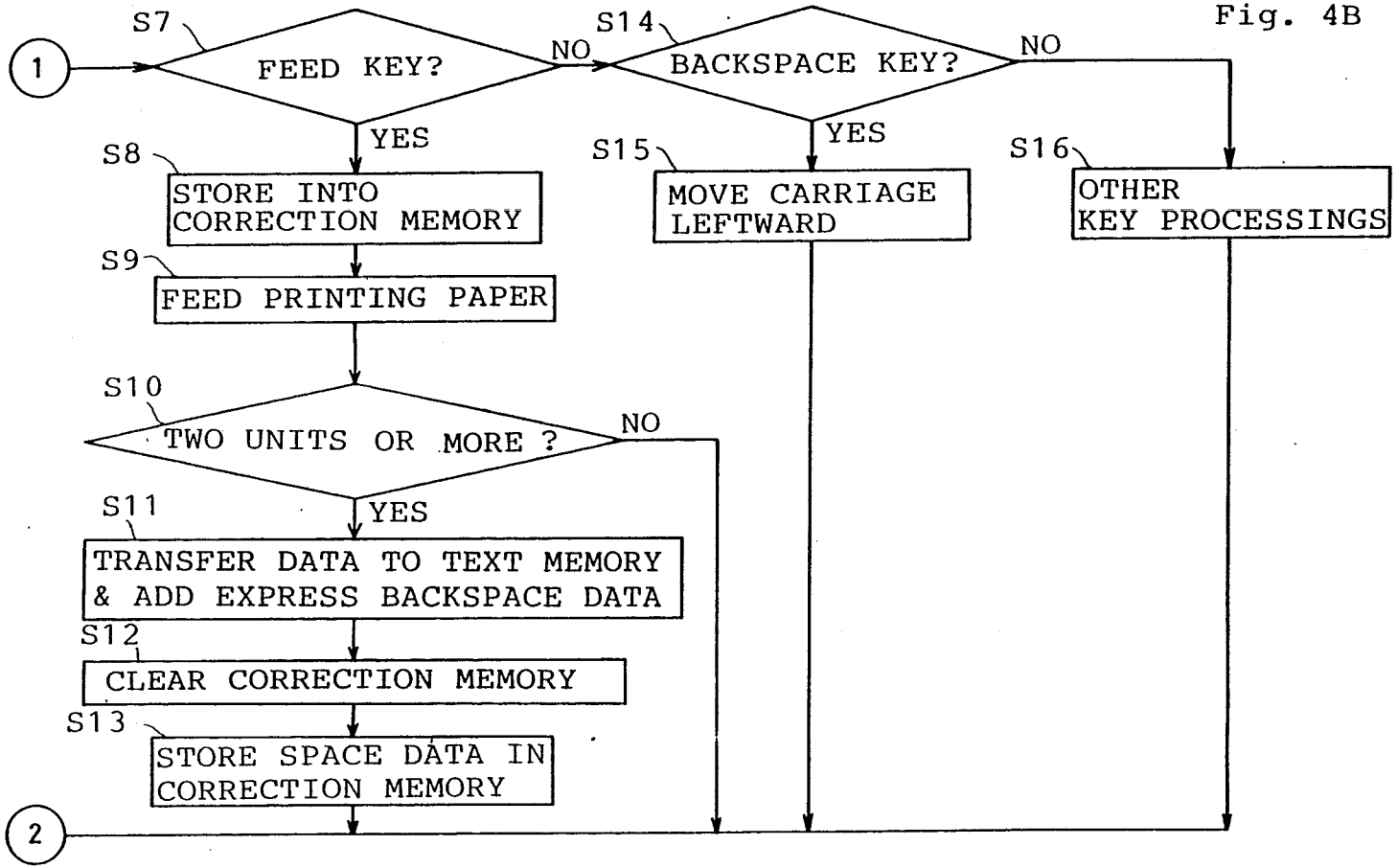

When the determination at step S4 is NO, the process proceeds to step S7 of FIG. 4B, at which it is determined if the operated key is a feed key such as the subscript key 5 or the superscript key 4. For example, when the subscript key 5 is operated, the process proceeds to step S8, where the CPU 50 stores the corresponding feed code data in the correction memory 112 in the operated order. At step S9, the CPU 50 controls the line feed motor 15 based on the feed code data to rotate the platen 13 by one unit in the normal direction so as to feed the printing paper 16 upward.

Then at step S10, it is determined if the printing paper 16 is fed more than or equal to two units of half line spacing from the first printed line. Specifically, the sum number of feed code data is counted in the correction memory 112. Here, the fore feed code and the back feed code, respectively corresponding to the subscript key 5 and the superscript key 4, are assigned a number of $+1$ and of $-1$ and the sum is taken algebraically. When the sum number is greater than or equal to 2, i.e., the determination result at step S10 is YES, the process proceeds to step S11, where data stored in the correction memory 112 are transferred to the text memory 110, and an express backspace code data is added at the end of the transferred data, i.e., after the feed code data, in the text memory 110. The express backspace code data is added because, as will be explained later, the same number of extra space code data will be stored in the text memory 110 after the already stored character code data. When, in the print mode, the CPU 50 finds the express backspace code in the text memory 110, the print head is carried to the left margin position after the characters in the first part of the line before the feed codes are printed and the same number of spaces are printed. Then the space code data is executed by the printing device 10, i.e., the print head is carried, or returned, to the position at the feed codes. Then the subsequent character data is printed normally. When the determination result at step S10 is NO, the process returns to step S1 of FIG. 4A.

At step S12, the data stored in the correction memory 112 are cleared. At step S13, the CPU 50 fills the correction memory 112 with a number of space code data based on the current position data from the current position memory 116. Here, the number of the space data is the same as that of the cleared character (including space) code data.

When the determination at step S7 is NO, the process proceeds to step S14 where it is determined if the operated key is the backspace key 6*a*. When the determination at step S14 is YES, the carriage 9 with the print head moves leftward by one character position at step S15, and the process returns to step S1 of FIG. 4A. Here, in the case where the printing paper is fed only by one unit, the carriage 9 follows data stored in the correction memory 112 reversely and when the CPU 50 finds the feed code data in the correction memory 112, the printing paper is fed in the opposite direction to that of the feed code data. On the other hand, in the case where the printing paper has been fed more than or equal to two units, as there is no feed code data in the correction memory 112 by the execution of step S11, and the printing paper is thus not fed and the print head is located on the same feed line.

When the determination at step S14 is NO, that is, a key other than the character keys 3*a*, the space key 3*b*, the return key 7, the feed keys 4 and 5, and the backspace key 6*a* is operated, processing according to the operated key is executed at step S16, and the process returns to S1 of FIG. 4A.

Examples for various key operations will be described according to explanatory figures of FIGS. 5 through 9 and flow charts of FIGS. 4A and 4B.

In FIGS. 5 through 9, the symbol designated by numeral 62 (left arrow) shows the express backspace code data, the symbol designated by numeral 63 (down arrow) shows the code data generated by the subscript key 5 and the symbol designated by numeral 60 (triangle) shows the current printing position to which the carriage 9 has been moved. Of course, these symbols are not actually printed on the printing paper 16.

Figure 5A:
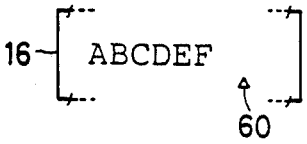
FIGS. 5 through 9 are explanatory figures showing examples of the operation of the embodiment wherein FIGS. 5*a*, 6*a*, 7*a*, 8*a*, and 9*a* each shows printed characters on a printing paper.
FIGS. 5*b*, 6*b*, 7*b*, 8*b*, and 9*b* each shows data stored in a correction memory.
Figure 5B:
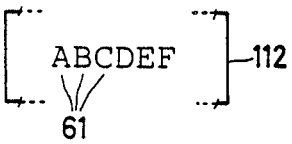

In FIG. 5 (*a*), when characters "ABCDEF" are entered by the character keys 3*a*, steps S1 to S3 are repeated. At that time, the character code data 61 are stored in the correction memory 112 as shown in FIG. 5 (*b*), but are not stored in the text memory 110.

Figure 6A:
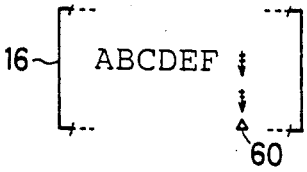
Figure 6B:
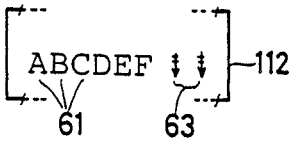

When the subscript key 5 is operated so as to feed the printing paper 16 more than or equal to two units, as shown in FIG. 6 (*a*), the process first proceeds to steps S1, S4 and S7 through S9. By these steps, data in the correction memory 112 are as shown in FIG. 6 (*b*). The data are not yet stored in the text memory 110 at this stage.

Figure 7A:
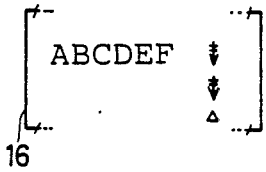
FIGS. 7*c*, 8*c*, and 9*c* each shows data stored in a text memory.
Figure 7B:
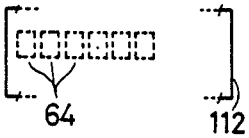
Figure 7C:
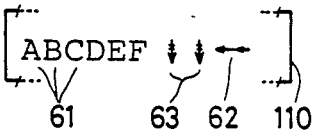

Since it is determined that the printing paper is fed more than or equal to two units at step S10, the process proceeds to steps S11 through S13. At step S11, as shown in FIG. 7 (*c*), the data in the correction memory 112 are transferred to the text memory 110, and an express backspace code data 62 is added at the end in the text memory 110. The correction memory 112 are cleared at step S12, space data, the number of which is equal to that of the cleared characters, are stored at the top of the correction memory 112 at step S13, as shown in FIG. 7 (*b*).

Figure 8A:
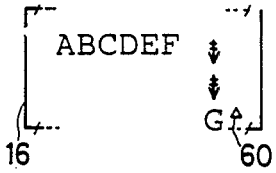
Figure 8B:
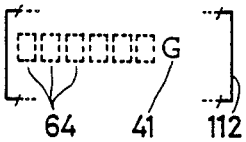
Figure 8C:
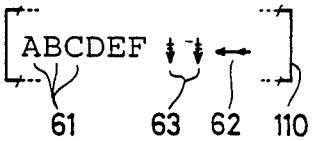

When a character "G" is then entered by the character key 3*a*, the process proceeds to steps S1 through S3 by which "G" is printed on the printing paper 16 as shown in FIG. 8 (*a*), and a character code data corresponding to "G" is stored into the correction memory 112 as FIG. 8 (*b*). The entry of the text memory 110 is not changed as shown in FIG. 8 (*c*).

Figure 9A:
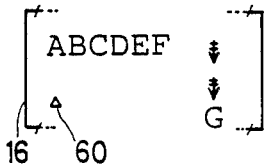
Figure 9B:
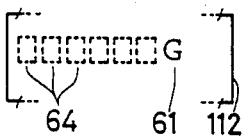
Figure 9C:
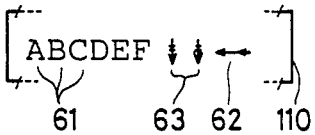
Figure 10:
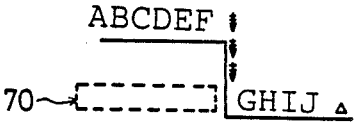
Fig. 10 PRIOR ART
FIG. 10 is an explanatory figure showing the movement of the printing position in the prior art.

When the backspace key 6*a* is continuously operated, steps S1, S4, S7, S14 and S15 are repeatedly executed. Thus, the carriage 9 moves leftward to a position as shown in FIG. 9 (*a*), based on the input signal from the backspace key 6*a* and the data stored in the correction memory 112. The character code data 61 in the correction memory 112 are shown in FIG. 9 (*b*) and the data 61 in the text memory 110 are shown in FIG. 9 (*c*).

Accordingly, in the electronic typewriter 1 of the invention, when the printing paper 16 is fed more than or equal to two units by operating the feed code key, the carriage 9 can be moved linearly leftward on the fed line only by operating the backspace key 6*a*.

In the foregoing description of the preferred embodiment, the explanation is based on the operating condition when both the type mode and the store mode are simultaneously selected. However, when only the type mode is selected, the processing done by the CPU 50 is substantially the same, with the exception of the processing, related to storing of the data in the text memory 110. Further, though the determination standard of the sum number of feed code data is set to be two units in the above embodiment, of course, it can be set at any value according to the objects of the invention.

Although the invention has been described with reference to a specific embodiment thereof, it will be apparent that numerous changes and modifications may be made therein without departing from the scope of the invention. It is, therefore, to be understood that it is not intended to limit the invention to the embodiments shown but only by the scope of the claims which follow.

What is claimed is:

1. In an electronic typewriter comprising:

a keyboard having a plurality of character keys including a space key for generating respective character code data and a space code data, and having a fore feed key and a back feed key for generating respective feed code data;

a printing mechanism having a carriage including a print head, a carriage transport mechanism and a paper feed mechanism; and control means for printing respective characters on a printing paper by the print head, for controlling the carriage transport mechanism to move the carriage forward responsive to the character code data and for controlling the paper feed mechanism to feed forward and backward the printing paper responsive to the fore and back feed code data respectively, including a line memory for storing the character code data and the feed code data in the operated order;

wherein the improvement is that the control means further comprises data clear means forming part of said control means for clearing data in the line memory responsive to the printing paper being fed both in a forward or a backward direction more than a preset amount of lines and for keeping the data in the line memory in other cases.

2. An electronic typewriter according to claim 1, wherein:

the clear means fill the line memory with a number of space code data, the number being the same as that of the cleared character code data including space code data when the data in the line memory are cleared.

3. An electronic typewriter according to claim 2, wherein:

the keyboard further includes a backward key for generating a backward code; and the control means, responsive to the backward code, drives the carriage transport mechanism to move the carriage backward and drives the paper feed mechanism reversely with respect to the feed code data in the memory means corresponding to current head position.

4. An electronic typewriter according to claim 3, wherein:

the keyboard further includes a correction key for generating a correction code;

the printing mechanism further includes a correction mechanism; and the control means, responsive to the correction code, drive the correction mechanism to erase a character printed on the printing paper at the current head position.

5. An electronic typewriter according to claim 4, wherein:

the print head includes a plurality of character type faces, a printing hammer and a printing ribbon;

the correction mechanism includes a correction ribbon; and the control means drive the hammer to hit the character type face corresponding to the character data at the current head position in the memory means via the correction ribbon responsive to the correction code on the printing paper.

6. An electronic typewriter according to claim 5, wherein:

the keyboard further includes a mode selector key whereby a type mode in which printing is executed directly on an operation of the keys, a store mode in which code data generated by respective keys are first stored in the line memory and then transferred to a text memory provided for the control means responsive to a carriage return code generated by an operation of a return key on the keyboard, and a print mode in which the code data stored in the text memory are consecutively processed by the printing mechanism are selected;

the clear means transfer the cleared data in the line memory to the text memory and add an express backspace code at the end of the transferred data when the data are cleared in the line memory in the store mode; and the control means return the carriage to a left margin position responsive to the express backspace code in the print mode.

7. An electronic typewriter according to claim 6, wherein: the data clear means clear data in the line memory when same feed code data are consecutively stored in the line memory more than the preset number, while for keeping the data in the line memory in other cases.

* * * * *